US009838799B2

(12) United States Patent
Doshida et al.

(10) Patent No.: US 9,838,799 B2
(45) Date of Patent: Dec. 5, 2017

(54) ELECTROACOUSTIC CONVERTER

(71) Applicant: TAIYO YUDEN CO., LTD., Taito-ku, Tokyo (JP)

(72) Inventors: Yutaka Doshida, Takasaki (JP); Yukihiro Matsui, Takasaki (JP); Hiroshi Hamada, Takasaki (JP)

(73) Assignee: TAIYO YUDEN CO., LTD, Tokyo (JP)

( * ) Notice: Subject to any disclaimer, the term of this patent is extended or adjusted under 35 U.S.C. 154(b) by 147 days.

(21) Appl. No.: 14/878,439

(22) Filed: Oct. 8, 2015

(65) Prior Publication Data

US 2016/0119721 A1 Apr. 28, 2016

(30) Foreign Application Priority Data

Oct. 24, 2014 (JP) ..... 2014-217519
Apr. 27, 2015 (JP) ..... 2015-090335

(51) Int. Cl.
*H04R 25/00* (2006.01)
*H04R 17/00* (2006.01)
(Continued)

(52) U.S. Cl.
CPC ..... *H04R 17/00* (2013.01); *H04R 1/1075* (2013.01); *H04R 1/24* (2013.01); *H04R 2217/01* (2013.01)

(58) Field of Classification Search
CPC .... H04R 1/1075; H04R 1/2811; H04R 17/00; H04R 1/22; H04R 1/24; H04R 1/26; H04R 5/033; H04R 7/04
(Continued)

(56) References Cited

U.S. PATENT DOCUMENTS 4,418,248 A * 11/1983 Mathis ..... H04R 1/26 381/190
5,430,803 A 7/1995 Kimura et al.
(Continued)

FOREIGN PATENT DOCUMENTS

JP S55029895 U 8/1980
JP S56130399 U 3/1981
(Continued)

OTHER PUBLICATIONS

A Notification of Reasons for Refusal issued by the Japanese Patent Office, dated Jul. 28, 2015, for Japanese counterpart application No. 2015-090335.
(Continued)

*Primary Examiner* — Brian Ensey
(74) *Attorney, Agent, or Firm* — Law Office of Katsuhiro Arai

(57) ABSTRACT

In an embodiment, an electroacoustic converter has an enclosure, piezoelectric sounding body, electromagnetic sounding body, passage, and wiring members. The piezoelectric sounding body includes a first vibration plate supported directly or indirectly on the enclosure, and a piezoelectric element placed at least on one side of the first vibration plate. The piezoelectric sounding body divides the interior of the enclosure into a first space and a second space. The electromagnetic sounding body has a second vibration plate and is placed in the first space. The passage is provided at the piezoelectric sounding body or around the piezoelectric sounding body, to connect the first space and second space. The wiring members are electrically connected to the piezoelectric element and led out toward the electromagnetic sounding body, from the piezoelectric element, through the first space or second space.

17 Claims, 13 Drawing Sheets

(51) Int. Cl.
*H04R 1/10* (2006.01)
*H04R 1/24* (2006.01)

(58) Field of Classification Search
USPC ..... 381/114, 173, 182, 186, 190, 370, 398
See application file for complete search history.

(56) References Cited

U.S. PATENT DOCUMENTS

| | | | | |
|---|---|---|---|---|
| 5,802,195 | A * | 9/1998 | Regan | H04R 17/00 381/190 |
| 2005/0023937 | A1 | 2/2005 | Sashida et al. | |
| 2016/0119719 | A1 | 4/2016 | Doshida et al. | |
| 2016/0119720 | A1 | 4/2016 | Doshida et al. | |
| 2016/0155926 | A1 | 6/2016 | Ishii et al. | |
| 2016/0157020 | A1 | 6/2016 | Ishii et al. | |
| 2016/0157021 | A1 | 6/2016 | Ishii et al. | |
| 2016/0183006 | A1 | 6/2016 | Tokuhisa et al. | |

FOREIGN PATENT DOCUMENTS

| | | | |
|---|---|---|---|
| JP | S57099899 | A | 6/1982 |
| JP | S61005090 | U | 1/1986 |
| JP | S6268400 | A | 3/1987 |
| JP | H03039000 | A | 2/1991 |
| JP | H06319190 | A | 11/1994 |
| JP | H11331976 | A | 11/1999 |
| JP | 2000341784 | A | 12/2000 |
| JP | 2004147077 | A | 5/2004 |
| JP | 2013150305 | A | 8/2013 |

OTHER PUBLICATIONS

A Notification of Reasons for Refusal issued by the Japanese Patent Office, dated Sep. 29, 2015, for Japanese counterpart application No. 2015-090335.

Non-Final Office Action issued by U.S. Patent and Trademark Office, dated Aug. 12, 2016, for co-pending U.S. Appl. No 14/843,476.

Final Office Action issued by U.S. Patent and Trademark Office, dated Jan. 13, 2017, for co-pending U.S. Appl. No. 14/843,476.

Non-Final Office Action issued by U.S. Patent and Trademark Office, dated Nov. 15, 2016, for co-pending U.S. Appl. No. 14/843,460.

* cited by examiner

[Fig. 1]
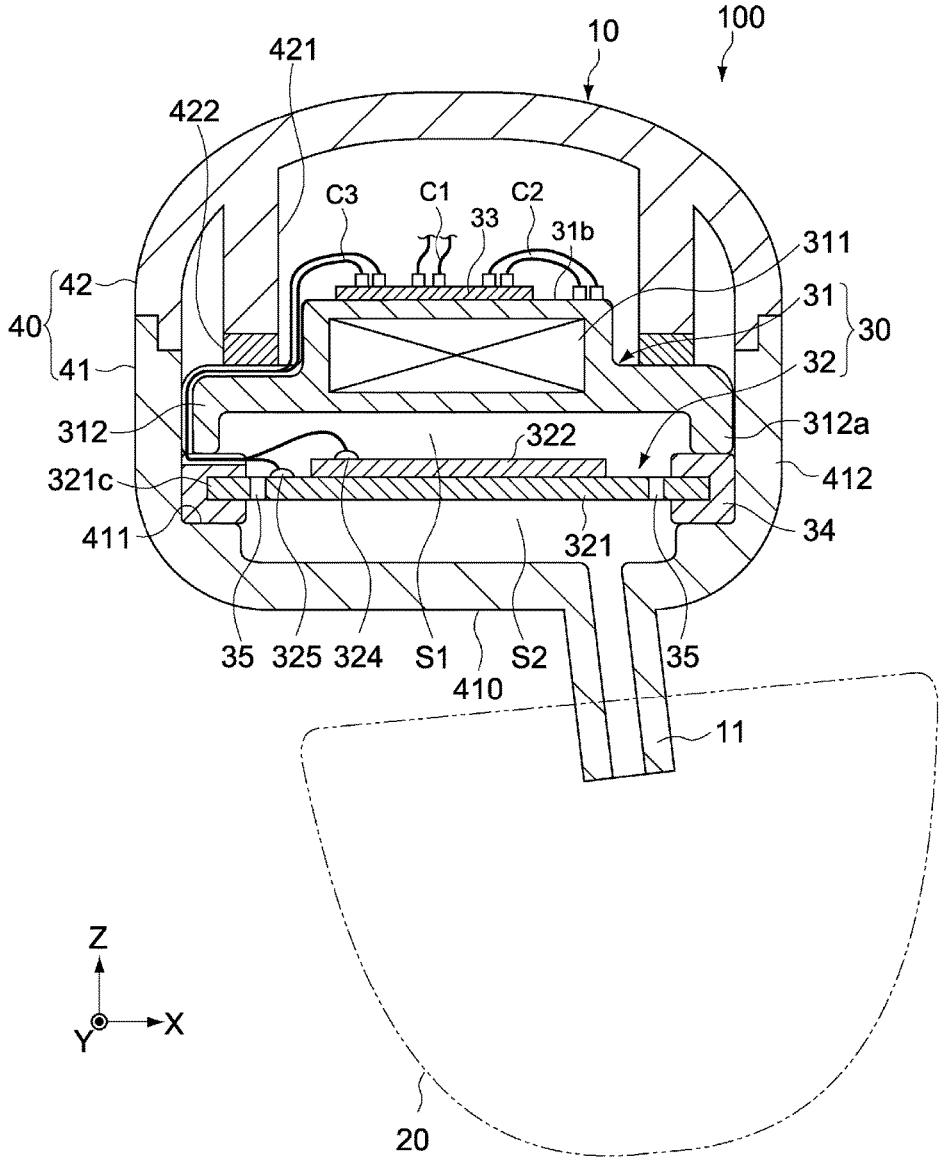

[Fig. 2]
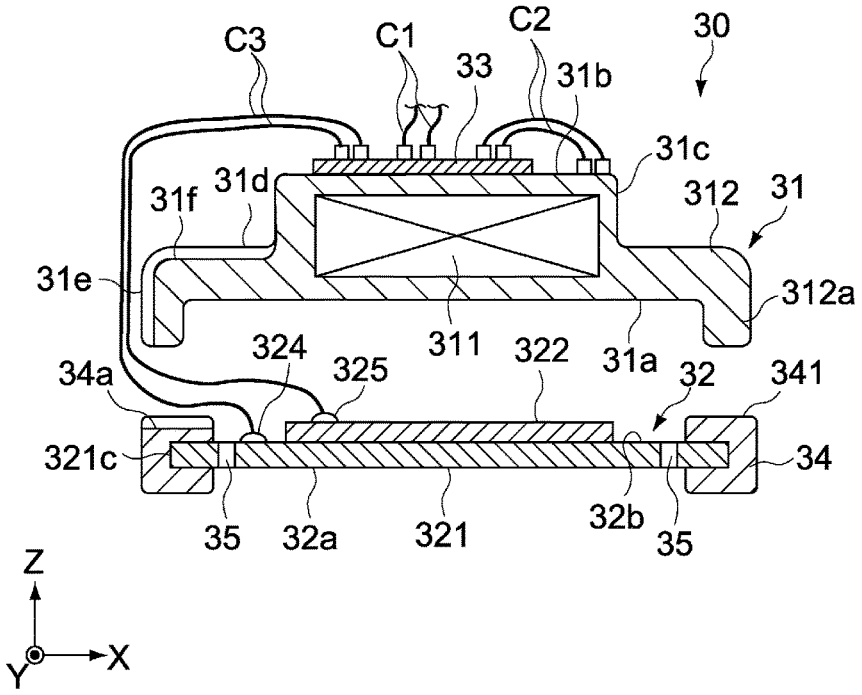
[Fig. 3]
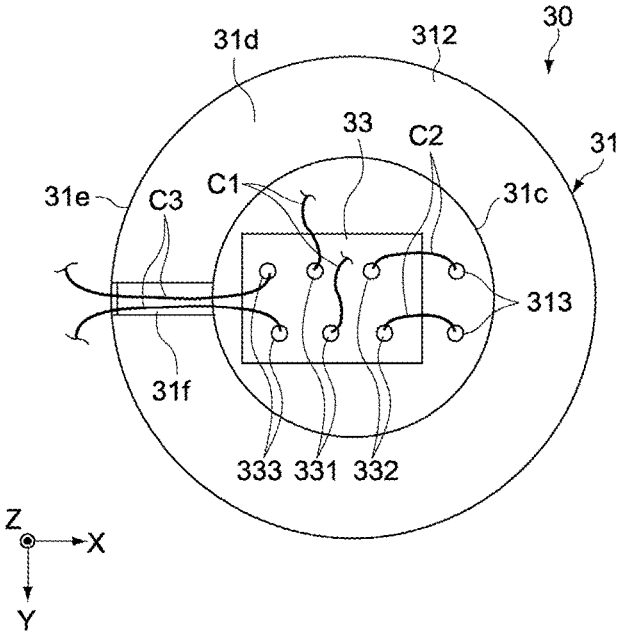

[Fig. 4]
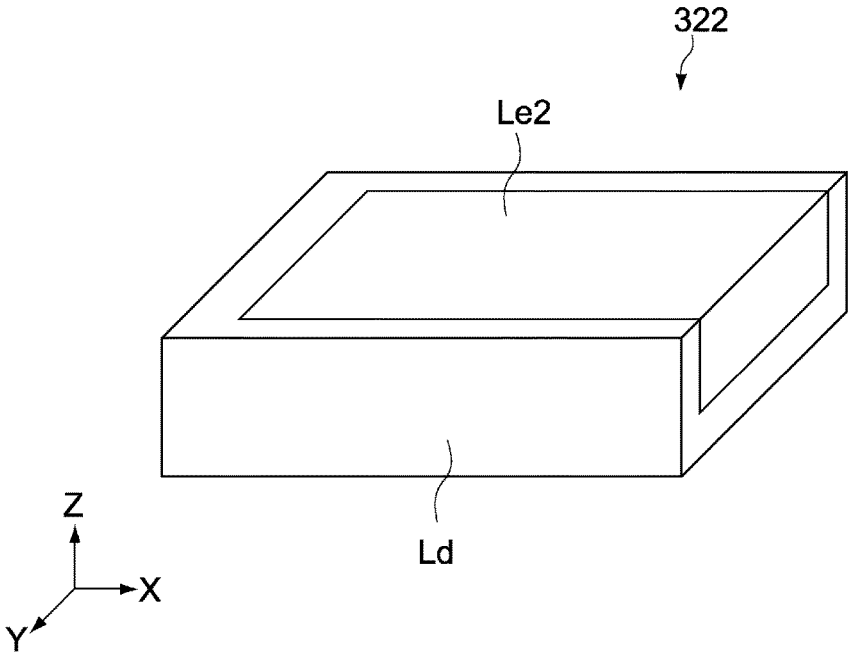
[Fig. 5]
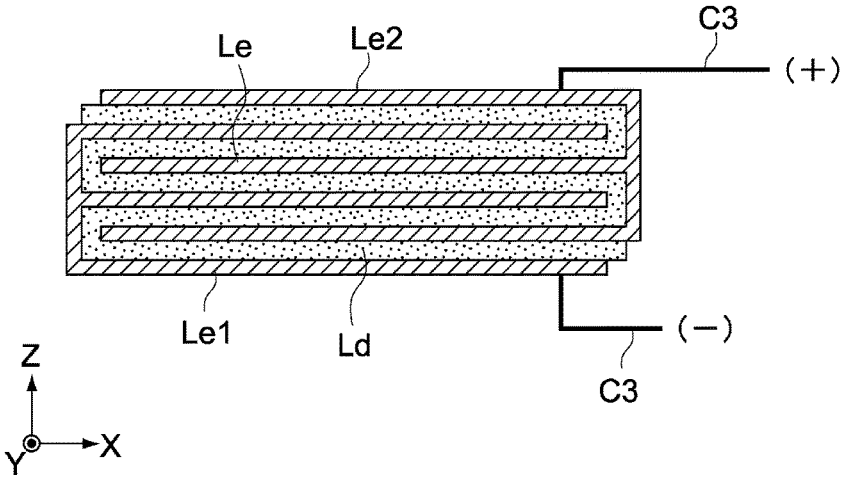

[Fig. 6]
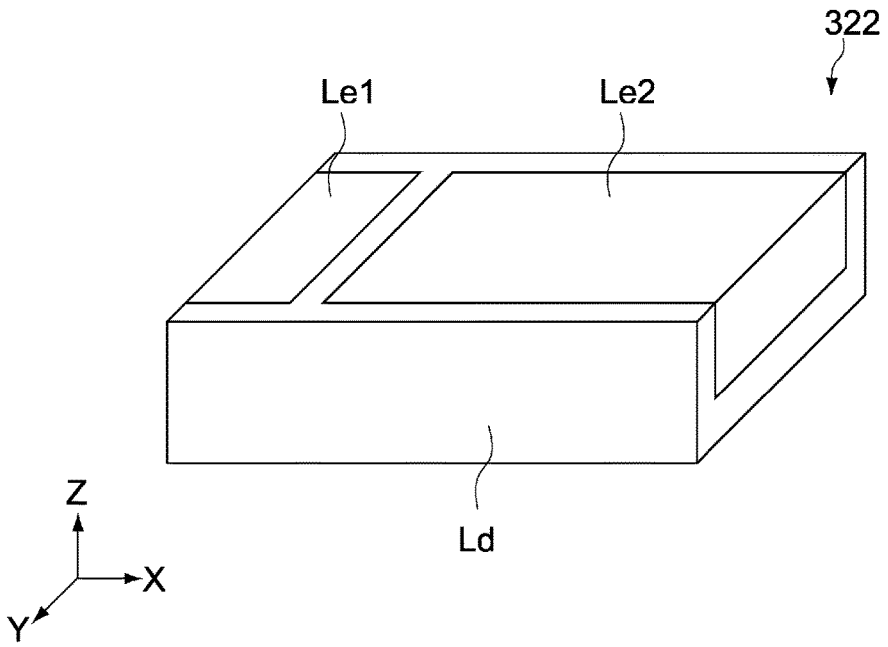
[Fig. 7]
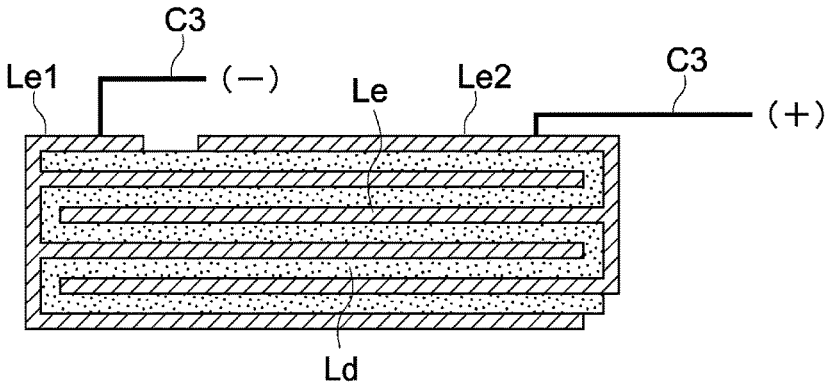

[Fig. 8]
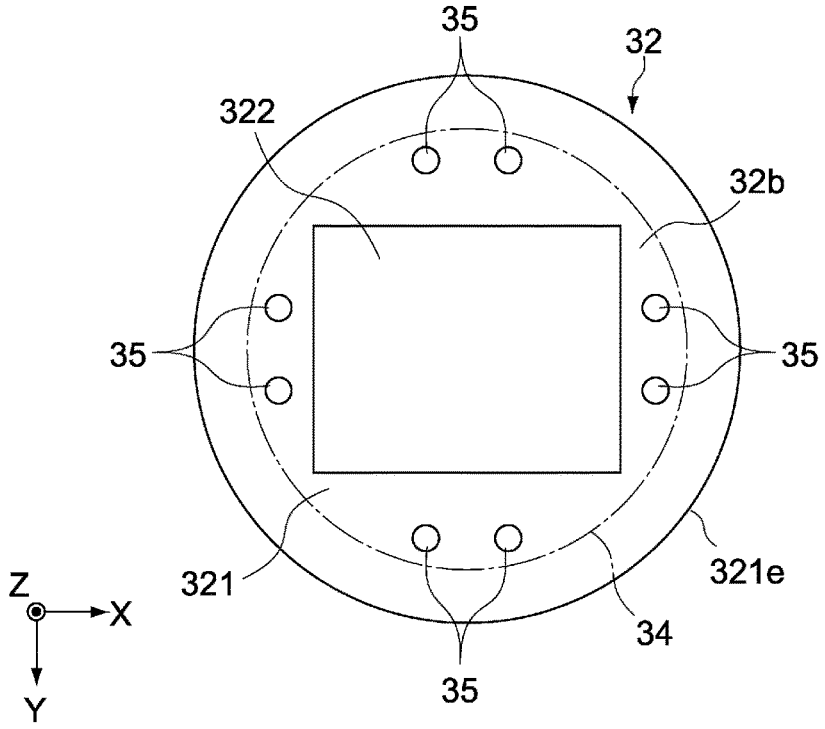
[Fig. 9]
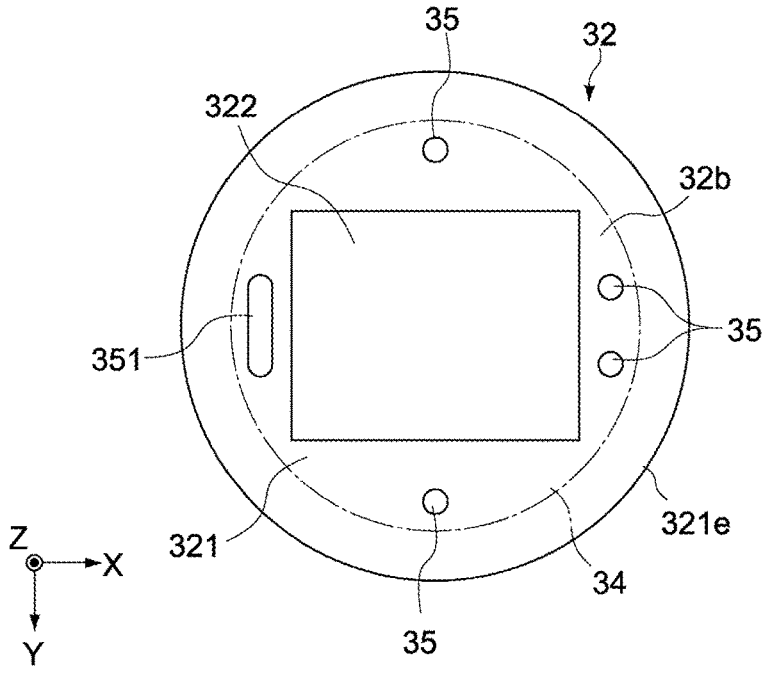

[Fig. 10]
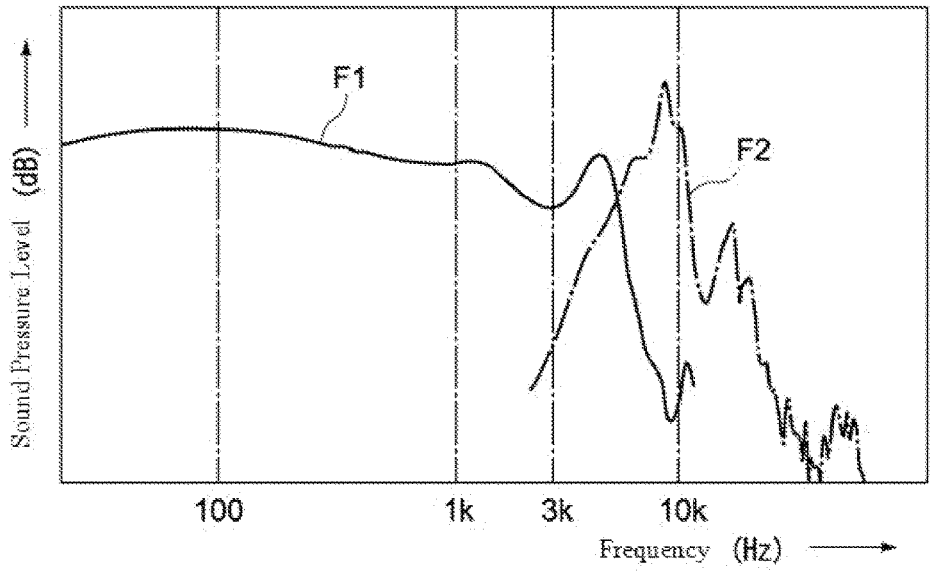
[Fig. 11]
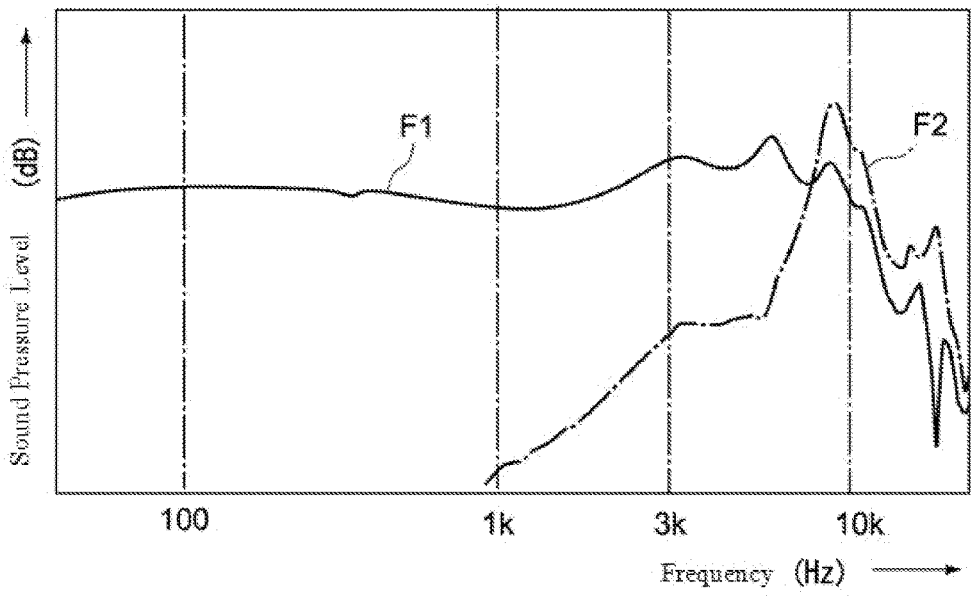

[Fig. 12]
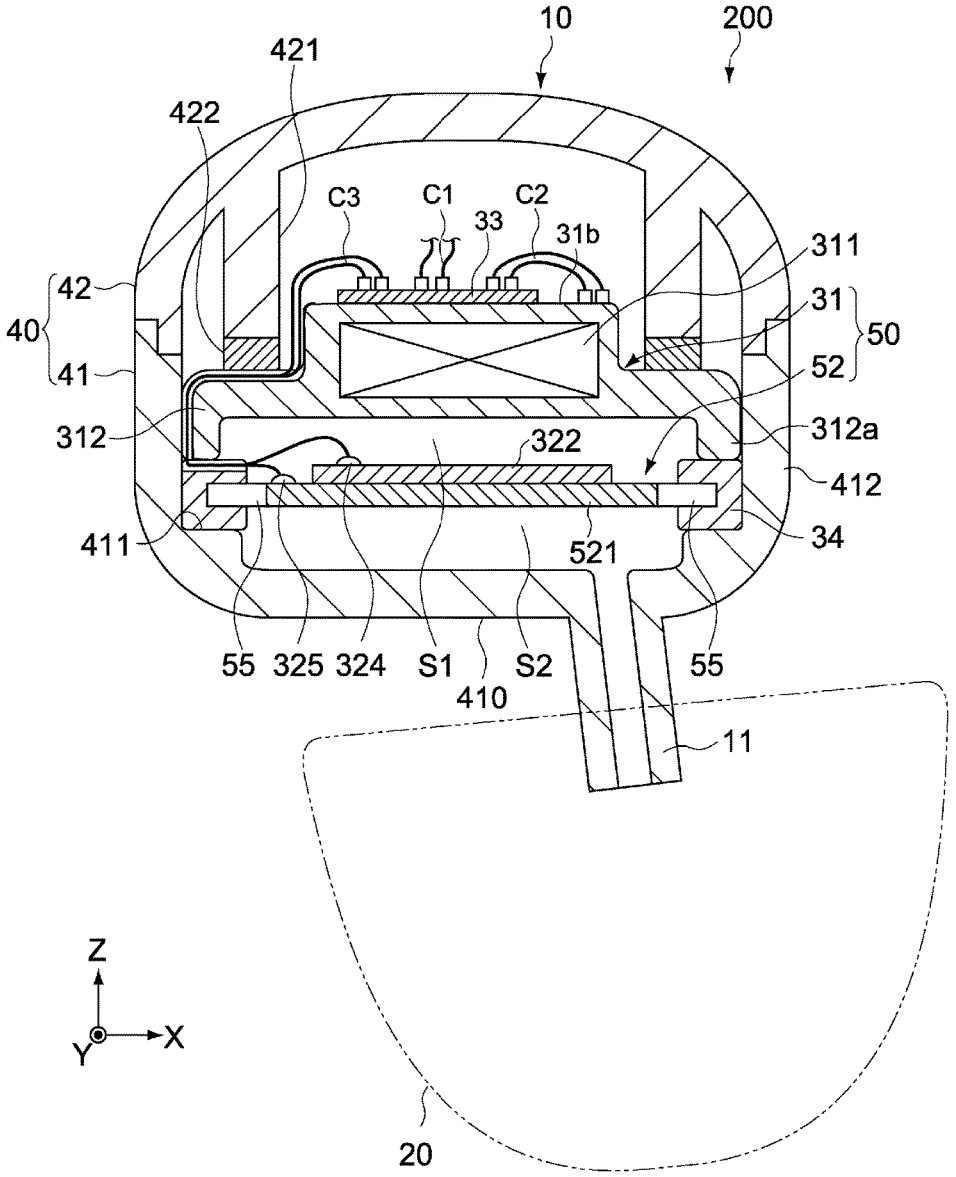

[Fig. 13]
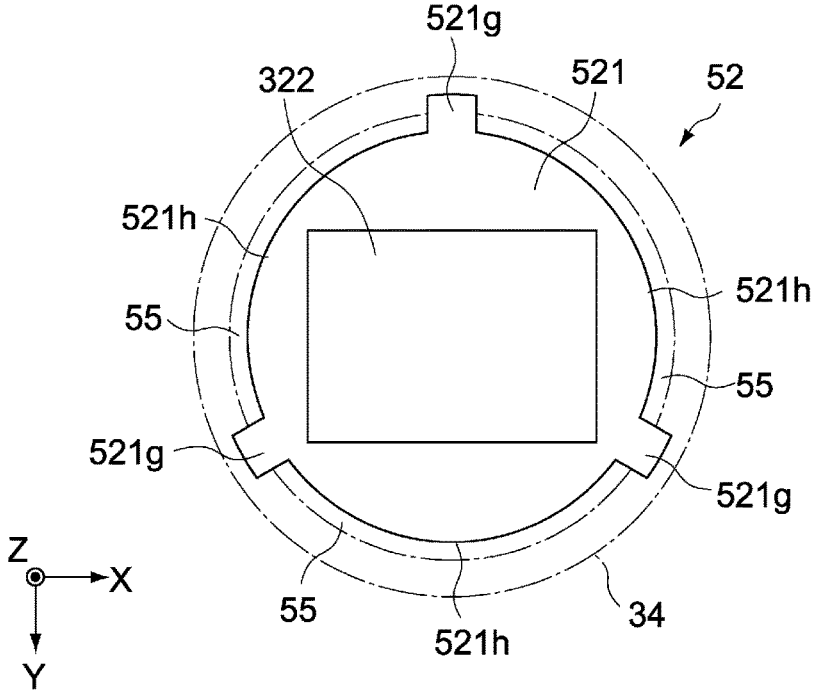
[Fig. 14]
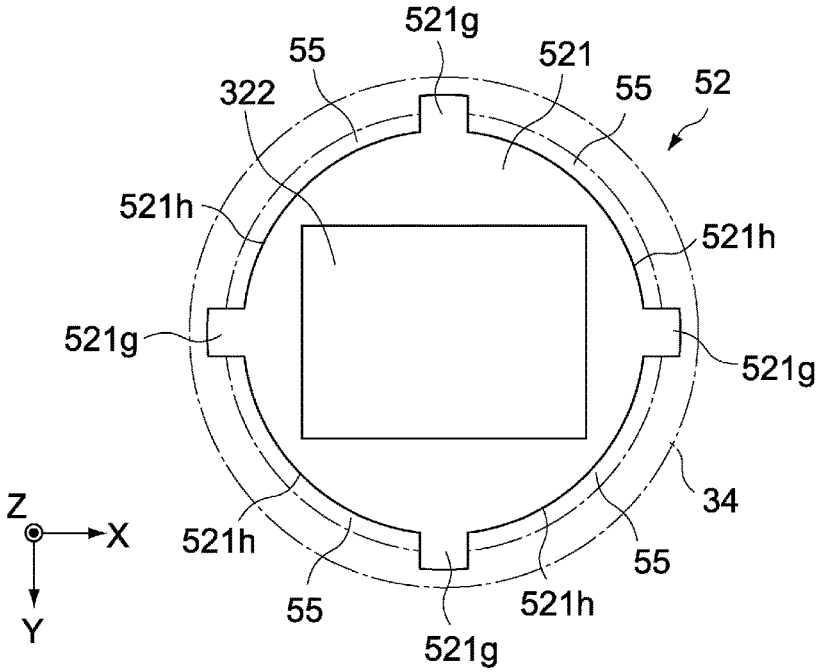

[Fig. 15]
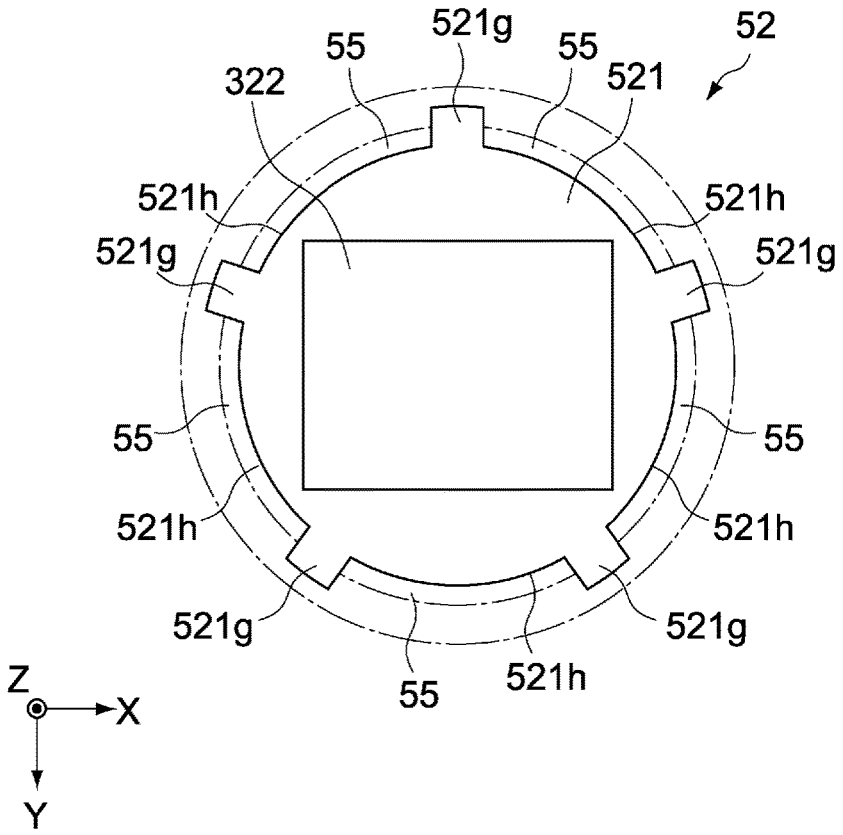

[Fig. 16]
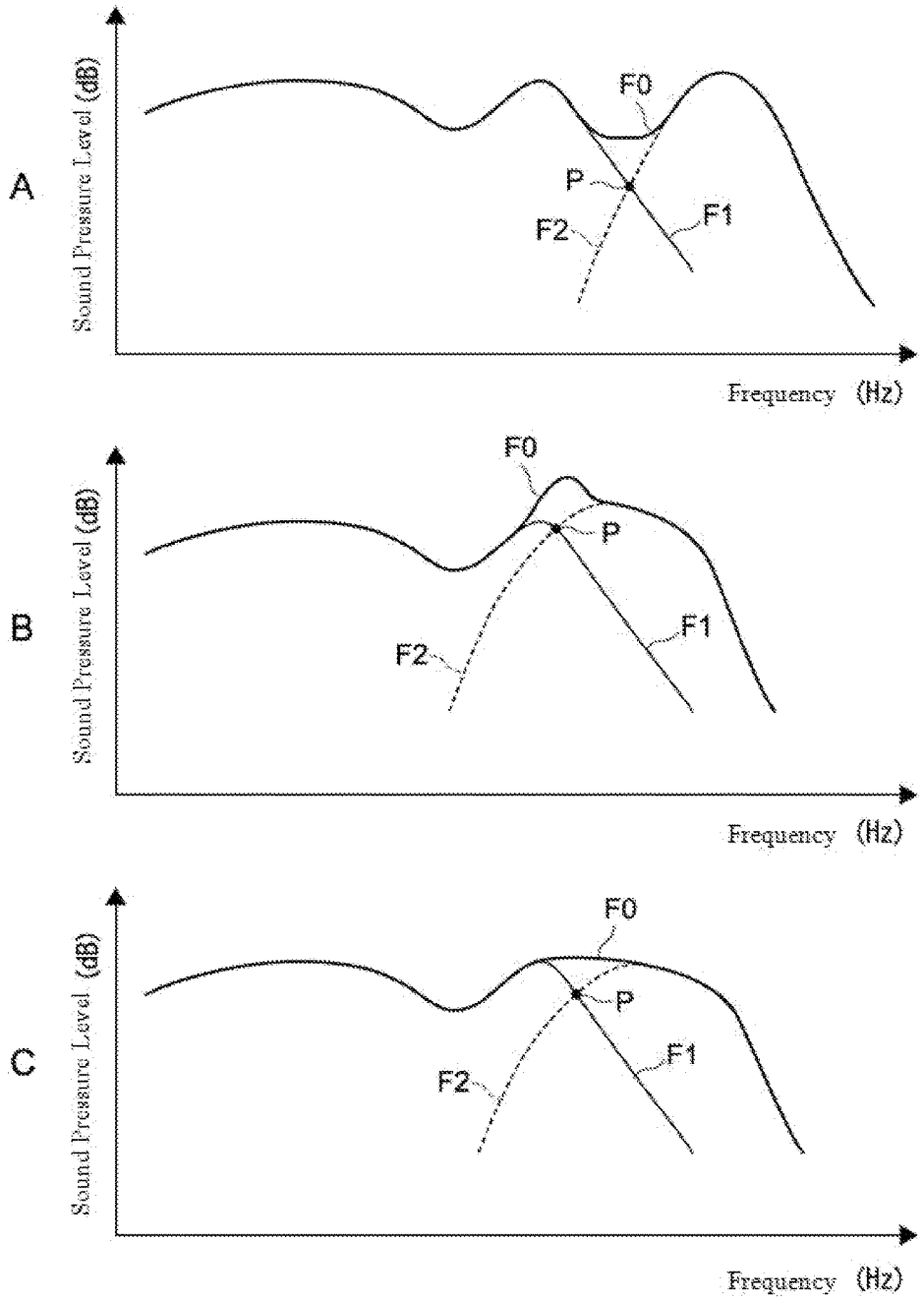

[Fig. 17]
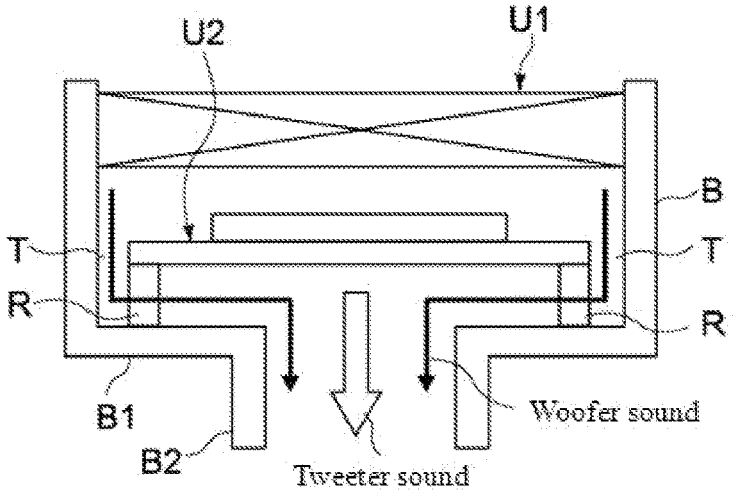
[Fig. 18]
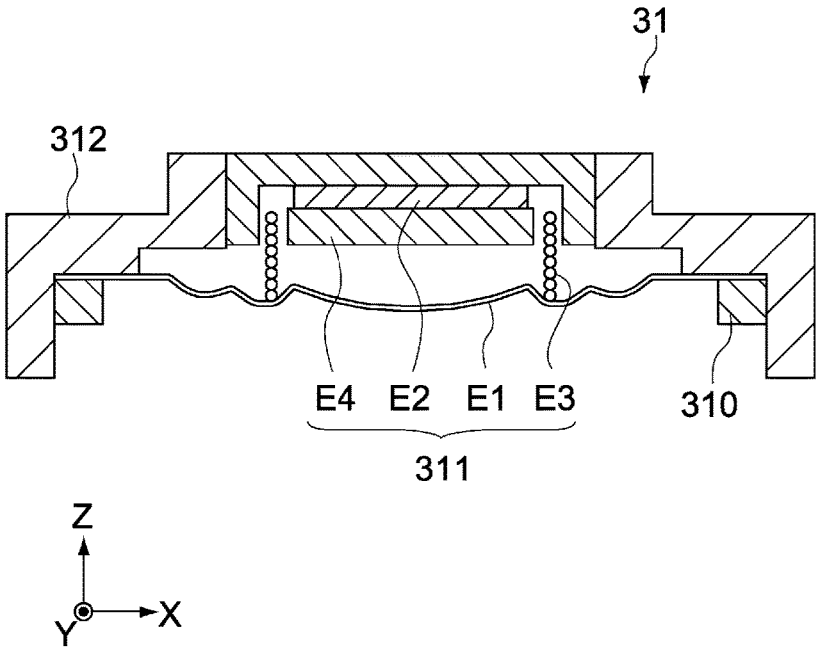

[Fig. 19]
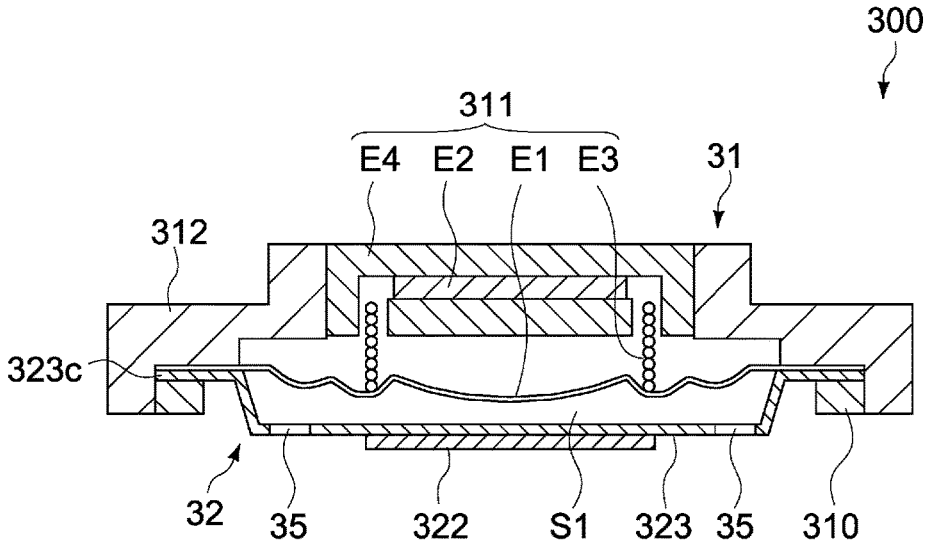

[Fig. 20]
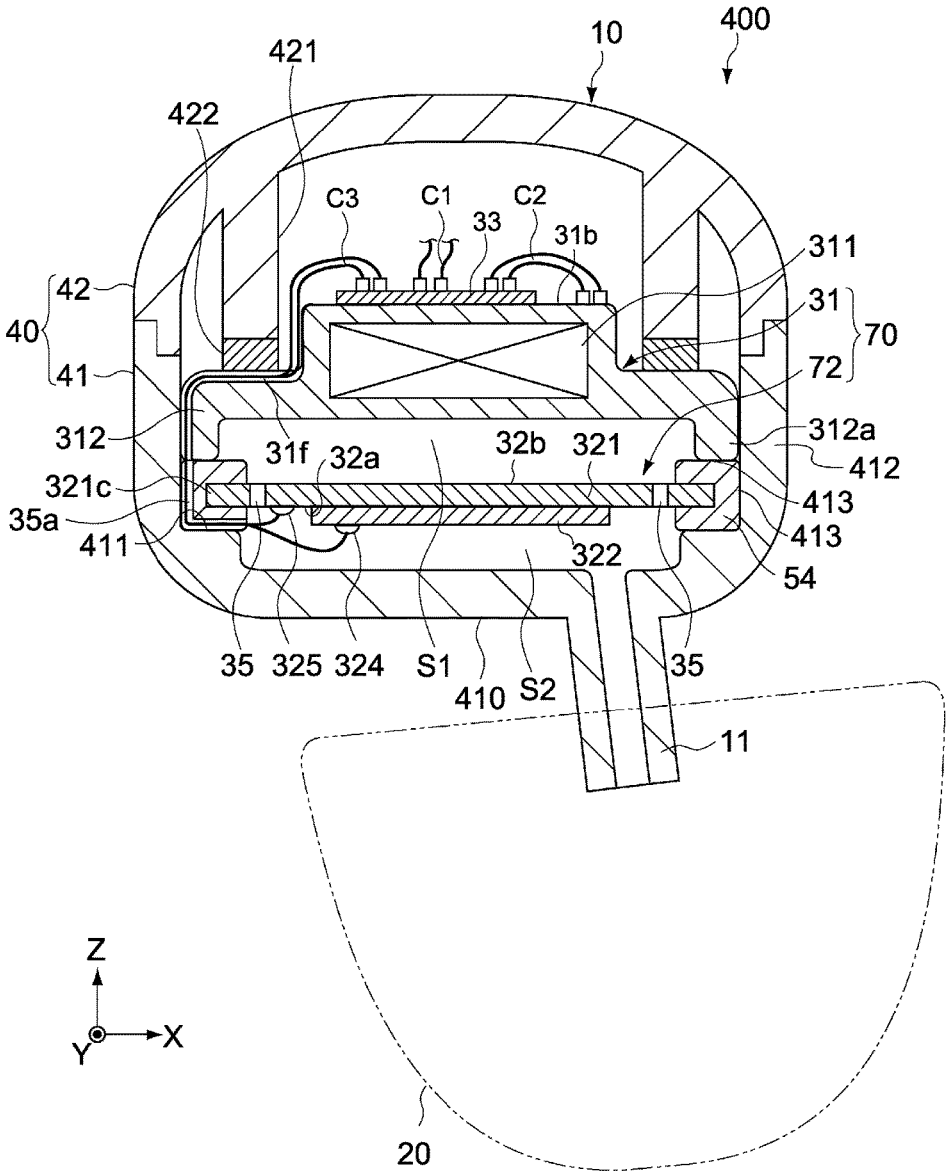

ELECTROACOUSTIC CONVERTER

BACKGROUND

Field of the Invention

The present invention relates to an electroacoustic converter that can be applied to earphones, headphones, mobile information terminals, etc., for example.

Description of the Related Art

Piezoelectric sounding elements are widely used as simple means for electroacoustic conversion, where popular applications include earphones, headphones, and other acoustic devices as well as speakers for mobile information terminals, etc. Piezoelectric sounding elements are typically constituted by a vibration plate and a piezoelectric element attached on one side or two sides of the plate (refer to Patent Literature 1, for example).

On the other hand, Patent Literature 2 describes headphones equipped with a dynamic driver and a piezoelectric driver, where these two drivers are driven in parallel to allow for wide playback bandwidths. The piezoelectric driver is provided at the center of the interior surface of a front cover that blocks off the front side of the dynamic driver and functions as a vibration plate, so that constitutionally this piezoelectric driver can function as a high-pitch sound driver.

BACKGROUND ART LITERATURES

[Patent Literature 1] Japanese Patent Laid-open No. 2013-150305

[Patent Literature 2] Japanese Utility Model Laid-open No. Sho 62-68400

SUMMARY

In recent years, there is a demand for greater ease of assembly and higher sound quality in the field of earphones, headphones and other acoustic devices, for example. However, the constitution of Patent Literature 2 presents a problem in that, because the dynamic driver is blocked off by the front cover, sound waves cannot be generated with desired frequency characteristics. To be specific, it is difficult to flexibly cope with the peak level adjustment in a specific frequency band, or the optimization of frequency characteristics at the cross point between the low-pitch sound characteristic curve and high-pitch sound characteristic curve, or the like.

In light of the aforementioned situations, an object of the present invention is to provide an electroacoustic converter capable of obtaining desired frequency characteristics easily, while providing greater ease of assembly at the same time.

Any discussion of problems and solutions involved in the related art has been included in this disclosure solely for the purposes of providing a context for the present invention, and should not be taken as an admission that any or all of the discussion were known at the time the invention was made.

To achieve the aforementioned object, an electroacoustic converter pertaining to an embodiment of the present invention has an enclosure, piezoelectric sounding body, electromagnetic sounding body, passage, and wiring members.

The piezoelectric sounding body includes a first vibration plate supported directly or indirectly on the enclosure, and a piezoelectric element placed at least on one side of the first vibration plate. In the above, "directly or indirectly" may refer to "without or with an intervening part" which is not a part of the enclosure. The piezoelectric sounding body divides the interior of the enclosure into a first space and a second space.

The electromagnetic sounding body has a second vibration plate and is placed in the first space.

The passage is provided at the piezoelectric sounding body or around the piezoelectric sounding body, to connect the first space and second space.

The wiring members are electrically connected to the piezoelectric element and led out toward the electromagnetic sounding body, from the piezoelectric element, through the first space or second space.

With the electroacoustic converter, sound waves generated by the electromagnetic sounding body are formed by composite waves having a sound wave component that propagates to the second space by vibrating the first vibration plate of the piezoelectric sounding body, and a sound wave component that propagates to the second space via the passage. Accordingly, sound waves output from the piezoelectric sounding body can be adjusted to desired frequency characteristics by optimizing the size of the passage, number of passages, etc. The electromagnetic sounding body is typically constituted so that it generates sound waves that are lower in pitch than sound waves generated by the piezoelectric sounding body. This way, frequency characteristics having a sound pressure peak in a desired low-pitch band can be obtained with ease, for example.

Also, because the passage is provided at the piezoelectric sounding body, the resonance frequencies of the first vibration plate (frequency characteristics of the piezoelectric sounding body) can be adjusted by the mode of the passage. This makes it easy to achieve desired frequency characteristics, such as flat composite frequencies around the cross point between the low-pitch sound characteristic curve by the electromagnetic sounding body and the high-pitch sound characteristic curve by the piezoelectric sounding body.

In addition, the passage functions as a low-pass filter that cuts, from among the sound waves generated by the electromagnetic sounding body, those high-frequency components of or above a specified level. This way, sound waves in a specified low-frequency band can be output without affecting the frequency characteristics of high-pitch sound waves generated by the piezoelectric sounding body.

And, the constitution where the wiring member electrically connected to the piezoelectric element is led out toward the electromagnetic sounding body, from the piezoelectric element, through the first or second space, allows the piezoelectric sounding body to be installed in the enclosure without losing any ease of operation.

As described above, according to the present invention, desired frequency characteristics can be obtained easily, while providing greater ease of assembly at the same time.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 1 is a schematic lateral section view showing an electroacoustic converter pertaining to an embodiment of the present invention.

FIG. 2 is a schematic lateral section view showing the electromagnetic sounding body and piezoelectric sounding body of the electroacoustic converter in a pre-assembled state.

FIG. 3 is a schematic plan view of the electromagnetic sounding body.

FIG. 4 is a schematic perspective view showing a constitutional example of the piezoelectric element constituting the piezoelectric sounding body.

FIG. 5 is a schematic lateral section view of the piezoelectric element in FIG. 4.

FIG. 6 is a schematic perspective view showing another constitutional example of the piezoelectric element.

FIG. 7 is a schematic lateral section view of the piezoelectric element in FIG. 6.

FIG. 8 is a schematic plan view showing a constitutional example of the piezoelectric sounding body.

FIG. 9 is a schematic plan view showing another constitutional example of the piezoelectric sounding body.

FIG. 10 is a drawing showing the frequency characteristics of an electroacoustic converter pertaining to a comparative example.

FIG. 11 is a drawing showing the frequency characteristics of the electroacoustic converter in FIG. 1.

FIG. 12 is a schematic lateral section view showing an electroacoustic converter pertaining to another embodiment of the present invention.

FIG. 13 is a schematic plan view showing a constitutional example of the piezoelectric sounding body of the electroacoustic converter in FIG. 12.

FIG. 14 is a schematic plan view showing another constitutional example of the piezoelectric sounding body.

FIG. 15 is a schematic plan view showing yet another constitutional example of the piezoelectric sounding body.

FIG. 16 is a drawing showing the frequency characteristics of the electroacoustic converter in FIG. 12.

FIG. 17 is a schematic diagram showing an example of constitutional variation of the electroacoustic converter.

FIG. 18 is a section view showing schematically the internal structure of the electromagnetic sounding body.

FIG. 19 is a section view of key parts, showing an example of constitutional variation of the electroacoustic converter.

FIG. 20 is a schematic lateral section view showing an electroacoustic converter pertaining to another embodiment of the present invention.

DESCRIPTION OF THE SYMBOLS

10 - - - Earphone body
11 - - - Sound path
20 - - - Earpiece
30, 50, 70, 300 - - - Sounding unit
31 - - - Electromagnetic sounding body
32, 52, 72 - - - Piezoelectric sounding body
34, 54 - - - Ring-shaped member
35, 55 - - - Passage
41 - - - Enclosure
321, 323, 521 - - - Vibration plate
322 - - - Piezoelectric element
S1 - - - First space
S2 - - - Second space

DETAILED DESCRIPTION OF EMBODIMENTS

Embodiments of the present invention are explained below by referring to the drawings.

First Embodiment

FIG. 1 is a schematic lateral section view showing the constitution of an earphone 100 as an electroacoustic converter pertaining to an embodiment of the present invention.

In the figure, the X-axis, Y-axis and Z-axis represent three axial directions crossing one another at right angles.

Overall Constitution of Earphone

The earphone 100 has an earphone body 10 and earpiece 20. The earpiece 20 is attached to a sound path 11 of the earphone body 10, while constituted in such a way that it can be worn in the user's ear.

The earphone body 10 has a sounding unit 30, and a housing 40 that houses the sounding unit 30.

The sounding unit 30 has an electromagnetic sounding body 31 and piezoelectric sounding body 32. The housing 40 has an enclosure 41 and cover 42.

Enclosure

The enclosure 41 has the shape of a cylinder with a bottom and is typically constituted by injection-molded plastics. The enclosure 41 has an interior space in which the sounding unit 30 is housed, and at its bottom 410 the sound path 11 is provided that connects to the interior space.

The enclosure 41 has a support 411 that supports the periphery of the piezoelectric sounding body 32, and a side wall 412 enclosing the sounding unit 30 all around. The support 411 and side wall 412 are both formed in a ring shape, where the support 411 is provided in such a way that it projects inward from near the bottom of the side wall 412. The support 411 is formed by a plane running in parallel with the XY plane, and supports the periphery of the piezoelectric sounding body 32 mentioned later either directly or indirectly via other member. It should be noted that the support 411 may be constituted by multiple pillars placed in a ring pattern along the inner periphery surface of the side wall 412.

Electromagnetic Sounding Body

The electromagnetic sounding body 31 is constituted by a speaker unit that functions as a woofer to play back low-pitch sounds. In this embodiment, it is constituted by a dynamic speaker that primarily generates sound waves of 7 kHz or below, for example, and has a mechanism 311 containing a voice coil motor (electromagnetic coil) or other vibration body, and a base 312 that vibratively supports the mechanism 311. The base 312 is formed roughly in the shape of a disk whose outer diameter is roughly identical to the inner diameter of the side wall 412 of the enclosure 41, and has a periphery surface 31*e* (FIG. 2) that engages with the side wall 412.

The constitution of the mechanism 311 of the electromagnetic sounding body 31 is not limited in any way. FIG. 18 is a section view of key parts, showing a constitutional example of the mechanism 311. The mechanism 311 has a vibration plate E1 (second vibration plate) vibratively supported on the base 312, permanent magnet E2, voice coil E3, and yoke E4 that supports the permanent magnet E2. The vibration plate E1 is supported on the base 312 by having its periphery sandwiched between the bottom of the base 312 and a ring-shaped fixture 310 assembled integrally to the bottom.

The voice coil E3 is formed by a conductive wire wound around a bobbin serving as a winding core, and is joined to the center of the vibration plate E1. Also, the voice coil E3 is positioned vertically to the direction of the magnetic flux of the permanent magnet E2 (Y-axis direction in the figure). As AC current (voice signal) flows through the voice coil E3, electromagnetic force acts upon the voice coil E3 and therefore the voice coil E3 vibrates in the Z-axis direction in the figure according to the signal waveform. This vibration is transmitted to the vibration plate E1 coupled to the voice coil E3 and vibrates the air inside the first space S1, and low-pitch sound waves generate as a result.

FIG. 2 is a schematic lateral section view of the sounding unit 30 in a state not yet assembled into the enclosure 41, while FIG. 3 is a schematic plan view of the sounding unit 30.

The electromagnetic sounding body 31 has the shape of a disk having a first surface 31*a* facing the piezoelectric sounding body 32 and a second surface 31*b* on the opposite side. Provided along the periphery of the first surface 31*a* is a leg 312*a* contactively facing the periphery of the piezoelectric sounding body 32. The leg 312*a* is formed in a ring shape, but it is not limited to the foregoing and may be constituted by multiple pillars.

The second surface 31*b* is formed on the surface of a disk-shaped projection 31*c* provided at the center of the top surface of the base 312. The second surface 31*b* has a circuit board 33 fixed to it that constitutes the electrical circuit of the sounding unit 30. Provided on the surface of the circuit board 33 are multiple terminals 331, 332, 333 that connect to various wiring members, as shown in FIG. 3. The circuit board 33 is typically constituted by a wiring board, but any board can be used so long as it has terminals that connect to various wiring members. Also, the location of the circuit board 33 is not limited to the second surface 31*b* as in the example, and it can be provided elsewhere such as on the interior wall of the cover 42, for example.

The terminals 331 to 333 are each provided as a pair. The terminal 331 connects to a wiring member C1 that inputs playback signals sent from a playback device not illustrated here.

The terminal 332 connects electrically to a terminal 313 of the electromagnetic sounding body 31 via a wiring member C2. The terminal 333 connects electrically to terminals 324, 325 of the piezoelectric sounding body 32 via a wiring member C3. It should be noted that the wiring members C2, C3 may be connected directly to the wiring member C1 without going through the circuit board 33.

Piezoelectric Sounding Body

The piezoelectric sounding body 32 constitutes a speaker unit that functions as a tweeter to play back high-pitch sounds. In this embodiment, its oscillation frequency is set in such a way to primarily generate sound waves of 7 kHz or above, for example. The piezoelectric sounding body 32 has a vibration plate 321 (first vibration plate) and piezoelectric element 322.

The vibration plate 321 is constituted by metal (such as 42 alloy) or other conductive material, or by resin (such as liquid crystal polymer) or other insulating material, and its plane is formed roughly circular. "Roughly circular" means not only circular, but also virtually circular as described later. The outer diameter and thickness of the vibration plate 321 are not limited in any way, and can be set as deemed appropriate according to the size of the enclosure 41, frequency band of playback sound waves, and so on. The outer diameter of the vibration plate 321 is set smaller than the outer diameter of the electromagnetic sounding body 31, and a vibration plate of approx. 12 mm in diameter and approx. 0.2 mm in thickness is used in this embodiment. It should be noted that the vibration plate 321 is not limited to a planer shape, and it can be a three-dimensional structure having a dome shape, etc.

The vibration plate 321 can have a concave shape sinking in from its outer periphery toward the inner periphery, or cutouts formed as slits, etc. It should be noted that the planar shape of the vibration plate 321, when not strictly circular due to formation of the cutouts, is considered virtually circular so long as the shape is roughly circular.

As shown in FIG. 1 and FIG. 2, the vibration plate 321 has a periphery 321*c* supported by the enclosure 41. The sounding unit 30 further has a ring-shaped member 34 placed between the support 411 of the enclosure 41 and the periphery 321*c* of the vibration plate 321. The ring-shaped member 34 has a support surface 341 that supports the leg 312*a* of the electromagnetic sounding body 31. The outer diameter of the ring-shaped member 34 is formed roughly identical to the inner diameter of the side wall 412 of the enclosure 41.

It should be noted that the periphery 321*c* of the vibration plate 321 includes the periphery of one principle surface (first principle surface 32*a*) of the vibration plate 321, periphery of the other principle surface (second principle surface 32*b*) of the vibration plate 321, and side surfaces of the vibration plate 321.

The material constituting the ring-shaped member 34 is not limited in any way, and it may be constituted by metal material, synthetic resin material, or rubber or other elastic material, for example. If the ring-shaped member 34 is constituted by rubber or other elastic material, resonance wobble of the vibration plate 321 is suppressed and therefore stable resonance action of the vibration plate 321 can be ensured.

The vibration plate 321 has the first principle surface 32*a* facing the sound path 11, and the second principle surface 32*b* facing the electromagnetic sounding body 31. In this embodiment, the piezoelectric sounding body 32 has a unimorph structure where the piezoelectric element 322 is joined only to the second principle surface 32*b* of the vibration plate 321.

The piezoelectric element 322 is not limited to the foregoing and it can be joined to the first principle surface 32*a* of the vibration plate 321. Also, the piezoelectric sounding body 32 may be constituted by a bimorph structure where a piezoelectric element is joined to both principle surfaces 32*a*, 32*b* of the vibration plate 321, respectively.

FIG. 4 is a schematic perspective view showing a constitutional example of the piezoelectric element 322, while FIG. 5 is a schematic section view of the example.

FIG. 6 is a schematic perspective view showing another constitutional example of the piezoelectric element 322, while FIG. 7 is a schematic section view of the example.

The planar shape of the piezoelectric element 322 is formed polygonal, and although it is a rectangle (oblong figure) in this embodiment, the shape can be square, parallelogram, trapezoid, or other quadrangle, or any polygon other than quadrangle, or circle, oval, ellipsoid, etc. The thickness of the piezoelectric element 322 is not limited in any way, either, and can be approx. 50 μm, for example.

The piezoelectric element 322 is structured as a stack of alternating multiple piezoelectric layers and multiple electrode layers.

Typically the piezoelectric element 322 is made by sintering at a specified temperature a stack of alternating multiple ceramic sheets (piezoelectric layers) Ld, each made of lead zirconate titanate (PZT), alkali metal-containing niobium oxide, etc., and having piezoelectric characteristics on one hand, and electrode layers Le on the other. The ends of respective electrode layers are led out alternately to both longitudinal end faces of the piezoelectric layer Ld. The electrode layers Le exposed to one end face are connected to a first leader electrode layer Le1, while the electrode layers Le exposed to the other end face are connected to a second leader electrode layer Le2. The piezoelectric element 322 expands and contracts at a specified frequency when a specified AC voltage is applied between the first and second leader electrode layers Le1, Le2, while the vibration plate 321 vibrates at a specified frequency. The numbers of piezoelectric layers and electrode layers to be stacked are not limited in any way, and the respective numbers of layers are set as deemed appropriate so that the required sound pressure can be obtained.

In the constitutional example of the piezoelectric element 322 in FIG. 4 and FIG. 5, the first leader electrode layer Le1 is formed from one end face to the bottom surface of the piezoelectric layer Ld, while the second leader electrode layer Le2 is formed from the other end face to the top surface of the piezoelectric layer Ld. The bottom surface of the piezoelectric element 322 is joined to the second principle surface 32*b* of the vibration plate 321 via conductive adhesive or other conductive material. In this case, the vibration plate 321 is constituted by metal material, but the second principle surface 32*b* may be constituted by insulating material covered with conductive material.

Accordingly in this embodiment, one wiring member C3 (first wiring member) of the two wiring members C3 is connected to the terminal 324 provided on the vibration plate 321, while the other wiring member C3 (second wiring member) is connected to the terminal 325 provided on the piezoelectric element 322, as shown in FIG. 2. The one terminal 324 is provided on the second principle surface 32*b* of the vibration plate 321, while the other terminal 325 is provided on the second leader electrode layer Le2 on the top surface of the piezoelectric element 322. This way, a specified drive voltage can be applied between the first and second leader electrode layers Le1, Le2.

On the other hand, in the constitutional example of the piezoelectric element 322 in FIG. 6 and FIG. 7, the first leader electrode layer Le1 is formed from one end face to one part of the top surface of the piezoelectric layer Ld, while the second leader electrode layer Le2 is formed from the other end face to the other part of the top surface of the piezoelectric layer Ld. In this case, the two leader electrode layers Le1, Le2 are exposed to the top surface of the piezoelectric element 322 in a manner adjacent to each other, the terminals 324, 325 may be provided on top of them. In this case, the vibration plate 321 may be constituted by insulating material.

As shown in FIG. 1, the piezoelectric sounding body 32 is assembled to the support 411 of the enclosure 41 with the ring-shaped member 34 installed on the periphery 321*c* of the vibration plate 321. An adhesive layer can be provided between the ring-shaped member 34 and support 411 to join the two. The interior space of the enclosure 41 is divided into a first space S1 and second space S2 by the piezoelectric sounding body 32. The first space S1 is a space where the electromagnetic sounding body 31 is housed, formed between the electromagnetic sounding body 31 and piezoelectric sounding body 32. The second space S2 is a space connecting to the sound path 11, formed between the piezoelectric sounding body 32 and the bottom of the enclosure 41.

The electromagnetic sounding body 31 is assembled onto the ring-shaped member 34. An adhesive layer is provided, as necessary, between the outer periphery of the electromagnetic sounding body 31 and the side wall 412 of the enclosure 41. This adhesive layer also functions as a sealing layer to enhance the air-tightness of the sound field forming space (first space S1) of the electromagnetic sounding body 31. Also the close contact of the electromagnetic sounding body 31 and ring-shaped member 34 allows a specified volume to be secured for the first space S1 in a stable manner, so that sound quality variation between products due to fluctuation of this volume can be prevented.

Cover

The cover 42 is fixed to the top edge of the side wall 412 so as to block off the interior of the enclosure 41. The interior top surface of the cover 42 has a pressure part 421 that presses the electromagnetic sounding body 31 toward the ring-shaped member 34. This way, the ring-shaped member 34 is sandwiched strongly between the leg 312*a* of the electromagnetic sounding body 31 and the support 411 of the enclosure 41, to allow the periphery 321*c* of the vibration plate 321 to be connected integrally to the enclosure 41.

The pressure part 421 of the cover 42 is formed as a ring, and its tip contacts a ring-shaped top surface 31*d* (refer to FIG. 2 and FIG. 3) formed around the projection 31*c* of the electromagnetic sounding body 31 via an elastic layer 422. This way, the electromagnetic sounding body 31 is pressed with a uniform force by the entire circumference of the ring-shaped member 34, thus making it possible to position the sounding unit 30 properly inside the enclosure 41. It should be noted that the formation of the pressure part 421 is not limited to a ring shape, and it may be constituted by multiple pillars.

A feedthrough is provided at a specified position of the cover 42, in order to lead the wiring member C1 connected to the terminal 331 of the circuit board 33 to a playback device not illustrated here.

Leader Structure for Wiring Member C3

The constitution of this embodiment is such that each wiring member C3 connected to the piezoelectric sounding body 32 is led out from the second principle surface 32*b* side of the vibration plate 321. In other words, the terminals 324, 325 of the piezoelectric sounding body 32 are placed facing the first space S1, which means a wiring path is needed to lead these wiring members C3 to the terminal 333 on the circuit board 33. Accordingly in this embodiment, a guide groove that can house each wiring member C3 is provided on the side periphery surface of the base 312 of the electromagnetic sounding body 31 and also on the ring-shaped member 34, and the wiring member C3 is constituted in such a way that it is led out toward the electromagnetic sounding body 31, from the piezoelectric sounding body 32, through the first space S1.

As shown in FIG. 2, a first guide groove 31*f* to house the multiple wiring members C3 wired between the first surface 31*a* and second surface 31*b* is provided on the periphery surface 31*e* and top surface 31*d* of the electromagnetic sounding body 31. This way, the wiring members C3 can be wired easily without risking damage between the periphery surface 31*e* of the electromagnetic sounding body 31 and the side wall 412 of the enclosure 41, and also between the top surface 31*d* of the electromagnetic sounding body 31 and the pressure part 421 of the cover 42.

The first guide groove 31*f* is formed in the diameter direction on the top surface 31*d*, and in the height direction (Z-axis direction) on the periphery surface 31*e*. The guide grooves 31*f* formed on the top surface 31*d* and periphery surface 31*e* are connected to each other. The first guide groove 31*f* is constituted as a square groove, but it may be constituted as a concave groove of round or other shape. The position at which the first guide groove 31*f* is formed is not limited in any way, but preferably it is provided at a position close to the terminal 333 on the circuit board 33, as shown in FIG. 3.

It should be noted that, if the pressure part 421 of the cover 42 is constituted by multiple pillars, the wiring members C3 can be guided between these pillars and therefore formation of guide groove 31*f* on the top surface 31*d* can be omitted.

On the other hand, a second guide groove 34*a* that can house multiple wiring members C3 is provided on the support surface 341 of the ring-shaped member 34. The second guide groove 34*a* is formed linearly in the diameter direction so as to connect the inner periphery and outer periphery of the ring-shaped member 34. The second guide groove 34*a* is formed at a position where it connects to the first guide groove 31*f* in a condition where the sounding unit 30 is assembled into the enclosure 41. This way, the wiring members C3 can be wired easily without risking damage between the leg 312*a* of the electromagnetic sounding body 31 and the ring-shaped member 34.

As described above, according to this embodiment, the electromagnetic sounding body 31 can be assembled to the enclosure 41 without losing any ease of operation.

Passage

When the first space S1 is closed in an air-tight manner, low-pitch sound waves may not be generated with desired frequency characteristics. To be specific, it is difficult to flexibly cope with the peak level adjustment in a specific frequency band, or the optimization of frequency characteristics at the cross point between the low-pitch sound characteristic curve and high-pitch sound characteristic curve, or the like.

Accordingly in this embodiment, passages 35 that connect the first space S1 and second space S2 are provided in the piezoelectric sounding body 32. FIG. 8 is a schematic plan view showing the constitution of the piezoelectric sounding body 32.

The passages 35 are provided in the thickness direction of the vibration plate 321. In this embodiment, the passages 35 are each constituted by multiple through holes provided in the vibration plate 321. As shown in FIG. 8, the passage 35 is formed at multiple locations around the piezoelectric element 322. Since the ring-shaped member 34 is attached to a periphery 321*e* of the vibration plate 321, the passages 35 are provided in the area between the piezoelectric element 322 and ring-shaped member 34. In this embodiment, the piezoelectric element 322 has a rectangular planar shape, so by providing the passages 35 in the area between at least one side of the piezoelectric element 322 and the periphery 321*c* (ring-shaped member 34) of the vibration plate 321, sufficient area in which to form the passages 35 can be secured without limiting the size of the piezoelectric element 322 more than necessary.

The passages 35 are used to pass some of the sound waves generated by the electromagnetic sounding body 31 from the first space S1 to the second space S2. Accordingly, low-pitch sound frequency characteristics can be adjusted or tuned by the number of passages 35, passage size, etc., meaning that the number of passages 35, passage size, etc., are determined according to the desired low-pitch sound frequency characteristics. Because of this, the number of passages 35 and passage size are not limited to those in the example of FIG. 8, and there may be one passage 35, for example.

It should be noted that the opening shape of the passage 35 is not limited to circular, either, and the number of openings may also be different from one location to another. For example, the passages 35 may include oval passages 351 as shown in FIG. 9.

Earphone Operation

Next, a typical operation of the earphone 100 of this embodiment as constituted above is explained.

With the earphone 100 of this embodiment, playback signals are input to the circuit board 33 of the sounding unit 30 via the wiring member C1. The playback signals are input to the electromagnetic sounding body 31 and piezoelectric sounding body 32 via the circuit board 33 and wiring members C2, C3, respectively. As a result, the electromagnetic sounding body 31 is driven to generate low-pitch sound waves primarily of 7 kHz or below.

With the piezoelectric sounding body 32, on the other hand, the vibration plate 321 vibrates due to the expansion/contraction action of the piezoelectric element 322, and high-pitch sound waves primarily of 7 kHz or above are generated. The generated sound waves in different bands are transmitted to the user's ear via the sound path 11. This way, the earphone 100 functions as a hybrid speaker having a sounding body for low-pitch sounds and sounding body for high-pitch sounds.

Here, sound waves generated by the electromagnetic sounding body 31 are formed by composite waves having a sound wave component that propagates to the second space S2 by vibrating the vibration plate 321 of the piezoelectric sounding body 32, and a sound wave component that propagates to the second space S2 via the passages 35. Accordingly, low-pitch sound waves output from the piezoelectric sounding body 32 can be adjusted or tuned to frequency characteristics that give a sound pressure peak in a specified low-pitch sound band, for example, by optimizing the size of the passage 35, number of passages, etc.

In this embodiment, the passages 35 are each constituted by a through hole penetrating the vibration plate 321 in its thickness direction, so the sound wave propagation path from the first space S1 to the second space S2 can be minimized (made the shortest). This makes it easier to set a sound pressure peak in a specified low-pitch sound range.

For example, FIG. 10 is a characteristic diagram of playback sound waves where the sound wave propagation path is longer than necessary. In the figure, the horizontal axis represents frequency and the vertical axis represents sound pressure level (in arbitrary units), while F1 indicates the frequency characteristics of low-pitch sounds played back by the electromagnetic sounding body and F2 indicates the frequency characteristics of high-pitch sounds played back by the piezoelectric sounding body. In the example of FIG. 10, there is a large dip near approx. 3 kHz. When a musical piece is played, generally the 3-kHz band corresponds to the frequency band of sounds uttered by vocalists. Accordingly, a dip in this band tends to decrease the quality of vocal sound.

On the other hand, FIG. 11 is a characteristic diagram similar to the one in FIG. 10, this time showing playback sound waves where the passage 35 is constituted by the shortest path. According to this embodiment, low-pitch sound frequency characteristics with a peak near 3 kHz can be achieved. This improves the quality of vocal sound, which in turn improves the playback quality of musical pieces.

Also, the passage 35 functions as a low-pass filter that cuts, from among the sound waves generated by the electromagnetic sounding body those high-frequency components of or above a specified level. This way, sound waves in a specified low-frequency band can be output without affecting the frequency characteristics of high-pitch sound waves generated by the piezoelectric sounding body 32.

Furthermore, according to this embodiment, the piezoelectric sounding body 32 is constituted in a manner leading all of the multiple wiring members C3 toward the second principle surface 32*b* side of the vibration plate 321, which improves not only the ease of connecting the wiring members C3 to the piezoelectric element 322, but also the ease of assembly to the enclosure 41, compared to when the wires are led out from the first principle surface 32*a* side of the vibration plate 321.

Moreover, the sounding unit 30 allows the electromagnetic sounding body 31 and piezoelectric sounding body 32 to be assembled into the enclosure 41 at once while being connected to each other via the wiring members C3, which improves the ease of assembly further. Also, the first and second guide grooves 31*f*, 34*a* that can house the wiring members C3 are provided on the periphery surface 31*e* of the electromagnetic sounding body 31 and the support surface 341 of the ring-shaped member 34, respectively, which allows for wiring of the wiring members C3 through proper paths without risking damage. This way, stable assembly accuracy can be ensured without requiring mastery of work.

Second Embodiment

FIG. 12 is a schematic section view of an earphone 200 pertaining to another embodiment of the present invention. Constitutions different from those of the first embodiment are primarily explained below, and the same constitutions as in the aforementioned embodiment are not explained or explained briefly using the same symbols.

The earphone 200 of this embodiment is different from the aforementioned first embodiment in terms of the constitution of a sounding unit 50, especially that of a piezoelectric sounding body 52. The piezoelectric sounding body 52 has a vibration plate 521, and the piezoelectric element 322 joined to one principle surface (principle surface facing the first space S1 in this example) of the vibration plate 521.

FIG. 13 is a schematic plan view showing the constitution of the piezoelectric sounding body 52. As shown in FIG. 13, multiple (three in the illustrated example) projecting pieces 521*g* that project radially outward in the diameter direction are provided along the periphery of the vibration plate 521. The multiple projecting pieces 521*g* are fixed to the inner periphery of the ring-shaped member 34. Accordingly, the vibration plate 521 is fixed to the support 411 of the enclosure 41 via the multiple projecting pieces 521*g* and ring-shaped member 34.

The multiple projecting pieces 521*g* are typically formed at equal angular intervals. The multiple projecting pieces 521*g* are formed by providing multiple cutouts 521*h* along the periphery of the vibration plate 521. How far the projecting pieces 521*g* project is adjusted by the cutout depth of the cutouts 521*h*.

Passages 55 that connect the first space S1 and second space S2 are provided in the piezoelectric sounding body 52. In this embodiment, the cutout depth of each cutout 521*h* is set so that arc-shaped openings of specified width are formed between the inner periphery surface of the ring-shaped member 34 and the multiple projecting pieces 521*g* positioned adjacent to each other. The openings form the passages 55 penetrating the vibration plate 521 in its thickness direction.

The number of passages 55, opening width in the diameter direction of the vibration plate 521, opening length in the circumferential direction of the vibration plate 521, etc., can be set as deemed appropriate, and are determined according to the desired low-pitch sound frequency characteristics. This way, playback sound frequency characteristics with a sound pressure peak in a specified low-pitch sound range (such as 3 kHz) can be achieved just like in the first embodiment. FIG. 14 shows a constitutional example of a vibration plate 521 having four projecting pieces 521*g*, while FIG. 15 shows a constitutional example of a vibration plate 521 having five projecting pieces 521*g*.

In addition, the vibration plates 521 in this embodiment are each constituted to vibrate around some or all of the multiple projecting pieces 521*g* as fulcrums, which makes it possible to adjust the resonance frequency of the vibration plate 521 according to the number of projecting pieces 521*g*, their shape, layout or fixing method. If the designed resonance frequency of the vibration plate 521 having four fulcrums as shown in FIG. 14 is 10 kHz, for example, the resonance frequency of the vibration plate 521 with three fulcrums as shown in FIG. 13 becomes lower, such as 8 kHz, while the resonance frequency of the vibration plate 521 with five fulcrums as shown in FIG. 15 becomes higher, such as 12 kHz. Besides the above, the thickness, outer diameter, material, etc., of the vibration plate 521 can also be used to adjust the resonance frequency.

As described above, the resonance frequency of the vibration plate 521 can be adjusted according to the number of projecting pieces 521*g*, etc., which makes it easy to achieve desired frequency characteristics, such as a flat composite frequency at the cross point between the low-pitch sound characteristic curve by the electromagnetic sounding body 31 and the high-pitch sound characteristic curve by the piezoelectric sounding body 52.

A in FIG. 16 through C in FIG. 16 are schematic diagrams explaining the relationship between the resonance frequency of the vibration plate 521 and the playback sound frequency characteristics of the earphone 200, where the horizontal axis represents frequency and the vertical axis represents sound pressure level. In each figure, F1 (thin solid line) indicates the frequency characteristics of low-pitch sounds played back by the electromagnetic sounding body 31, F2 (broken line) indicates the frequency characteristics of high-pitch sounds played back by the piezoelectric sounding body 52, and F0 (thick solid line) indicates the composite characteristics of the foregoing. Furthermore, P indicates the point of intersection between the curves F1 and F2, or specifically the cross point mentioned above.

In A through C in FIG. 16, the resonance frequency of the vibration plate 521 increases in the order of B, C and A.

In the example of A in FIG. 16, a dip is likely to occur in the band of the cross point P, while in the example of B in FIG. 16, a peak is likely to occur in the band of the cross point P. In the example of C in FIG. 16, on the other hand, flat characteristics are achieved in the band of the cross point P.

Generally with hybrid speakers, one important point in sound quality tuning is the cross point between the low-pitch sound characteristic curve and high-pitch sound characteristic curve. Typically the cross point is adjusted so that the composite frequencies of low-pitch sounds and high-pitch sounds become flat in the band of the cross point P, as shown in C in FIG. 16. According to this embodiment, the resonance frequency of the vibration plate 521 can be adjusted according to the number of fulcrums (projecting pieces 521*g*) of the vibration plate 521, which makes it possible to easily achieve desired frequency characteristics, such as flat characteristics in the band of the cross point P.

Third Embodiment

FIG. 20 is a schematic section view of an earphone 400 pertaining to another embodiment of the present invention. Constitutions different from those of the first embodiment are primarily explained below, and the same constitutions as in the aforementioned embodiment are not explained or explained briefly using the same symbols.

The earphone 400 of this embodiment is different from the aforementioned first embodiment in terms of the constitution of a sounding unit 70, especially that of a piezoelectric sounding body 72. The sounding unit 70 has an electromagnetic sounding body 31 and piezoelectric sounding body 72. The piezoelectric sounding body 72 is constituted in the same manner as the piezoelectric sounding body 32 in the first embodiment, except that the piezoelectric element 322 is joined to the second principle surface 32*a* of the vibration plate 321. The sounding unit 70 further has a ring-shaped member 54 placed between the support 411 of the enclosure 41 and the periphery 321*c* of the vibration plate 321.

The ring-shaped member 54 has a contact surface 413 that contacts the support 411, and a second guide groove 35*a* that is provided on the contact surface 413, connects to the first guide groove 31*f*, and stores the wiring member C3. The contact surface 413 includes the outer periphery surface ad bottom surface of the ring-shaped member 54. The second guide groove 35*a* is formed along the outer periphery surface and bottom surface of the ring-shaped member 54, where it is linearly formed in the height direction (Z-axis direction) on the outer periphery surface and in the diameter direction on the bottom surface. The second guide groove 35*a* can house multiple wiring members C3 just like the first guide groove 31*f*.

The wiring member C3 is electrically connected to the piezoelectric element 322 and led out toward the electromagnetic sounding body 31, from the piezoelectric element 322, through the second space S2. In other words, the terminals 324, 325 of the piezoelectric sounding body 72 are positioned in a manner facing the second space S2, and the wiring members C3 connected to the terminals 324, 325 are led to the terminal 333 on the circuit board 33 via the second guide groove 35*a* and first guide groove 31*f*. According to this embodiment, where the second guide groove 35*a* faces the second space S2 and no guide groove facing the first space S1 is provided, the first space S1 has greater airtightness. This way, leakage of sound pressure from the electromagnetic sounding body 31 is prevented and low-pitch sound pressures become easier to control. Also, wiring vibration from the guide grooves caused by sound pressure leakage and wiring interference may generate audible noises in the form of rattles (abnormal sounds, noises); according to this embodiment, however, such rattles can be prevented because each wiring member C3 is positioned on the opposite side of the electromagnetic sounding body 31 with respect to the piezoelectric sounding body 72.

Also, the sounding unit 70 allows the electromagnetic sounding body 31 and piezoelectric sounding body 72 to be assembled into the enclosure 41 at once while being connected to each other via the wiring members C3, which improves the ease of assembly. Also, the first and second guide grooves 31*f*, 35*a* that can house the wiring members C3 are provided on the periphery surface 31*e* of the electromagnetic sounding body 31 and the contact surface 413 of the ring-shaped member 34, respectively, which allows for wiring of the wiring members C3 through proper paths without risking damage. This way, stable assembly accuracy can be ensured without requiring mastery of work.

While the piezoelectric element 322 is joined to the second principle surface 32*a* of the vibration plate 321 in this embodiment, it can also be joined to the first principle surface 32*b*. In this case, each wiring member C3 is led out from the first principle surface 32*b* side, guided through the passage 35, and stored in the second guide groove 35*a*. In other words, the wiring member C3 is led out toward the electromagnetic sounding body, from the piezoelectric element 322, through the first space S1. Such constitution can be applied to each of the aforementioned embodiments.

The foregoing explained embodiments of the present invention, but the present invention is not limited to the aforementioned embodiments and it goes without saying that various modifications may be added.

For example, in the aforementioned embodiments the passages that guide low-pitch sound waves to the sound path were provided in the piezoelectric sounding body; however, the passages are not limited to the foregoing and may be provided around the piezoelectric sounding body. In this case, the outer diameter of the piezoelectric sounding body U2 is formed smaller than the inner diameter of the side wall of the enclosure B, as shown schematically in FIG. 17, for example, and passages T through which to pass low-pitch sound waves generated by the electromagnetic sounding body U are formed between the two. It should be noted that the piezoelectric sounding body U2 is fixed to the bottom B1 of the enclosure B via multiple support pillars R. This way sound waves passing through the passages T can be guided to the sound path B2.

Also, the aforementioned embodiments were explained using earphones 100, 200, 300 as examples of the electroacoustic converter, but the present invention is not limited to the foregoing and can also be applied to headphones, hearing aids, etc.

In addition, the present invention can also be applied as speaker units installed in mobile information terminals, personal computers and other electronic devices.

Furthermore, with the sounding units 30, 50, 70 of the respective embodiments above, the electromagnetic sounding body 31 and piezoelectric sounding body 32 (52, 72) were constituted as separate components; however, they may be constituted as one integral component. For example, FIG. 19 shows a constitutional example of a sounding unit 300 constituted by the electromagnetic sounding body 31 and piezoelectric sounding body 32 joined integrally together.

In FIG. 19, a periphery 323*c* of a vibration plate 323 of the piezoelectric sounding body 32 is fixed to the base 312, together with the periphery of the vibration plate E1 of the electromagnetic sounding body 31, by the ring-shaped fixture 310. The ring-shaped fixture 310, when assembled to the base 312, constitutes a fixing part that commonly supports the peripheries of the two vibration plates 323, E1. Also, the center area of the vibration plate 323 of the piezoelectric sounding body 32, which is joined to the piezoelectric element 322 to constitute a vibration surface, has the shape of a shallow bowl curving from the periphery 323*c* in the direction of moving away from the vibration plate E1 of the electromagnetic sounding body 31. This way, the two vibration plates 323, E1 can vibrate independently without interfering with each other.

Also, the passage 35 through which the low-pitch sound waves generating at the electromagnetic sounding body 31 can pass is provided in the center area of the vibration plate 323. The passage 35 is constituted by a through hole as in the first embodiment, but it may also be constituted by a cutout formed along the periphery 323*c* as in the second embodiment.

According to the sounding unit 300 of the above constitution, where the electromagnetic sounding body 31 and piezoelectric sounding body 32 are constituted as one mutually integral component, the sounding unit 300 can have a simpler and thinner constitution. The number of components can also be reduced, which improves the ease of assembly of the electroacoustic converter.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2014-217519, filed Oct. 24, 2015 and No. 2015-090335, filed Apr. 27, 2015, each disclosure of which is incorporated herein by reference in its entirety, including any and all particular combinations of the features disclosed therein, for some embodiments.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. An electroacoustic converter comprising:

an enclosure;

a piezoelectric sounding body that includes a first vibration plate supported directly or indirectly on the enclosure, and a piezoelectric element placed at least on one side of the first vibration plate, and divides an interior of the enclosure into a first space and a second space;

an electromagnetic sounding body having a second vibration plate and positioned in the first space;

a passage provided at the piezoelectric sounding body or around the piezoelectric sounding body, to connect the first space and second space; and wiring members led out toward the electromagnetic sounding body, from the piezoelectric element, through the first space or second space, wherein the passage is provided in the first vibration plate in its thickness direction and constituted by one or multiple through holes provided in the first vibration plate.

2. An electroacoustic converter according to claim 1, wherein the enclosure has a support that directly or indirectly supports a periphery of the vibration plate, and side walls that surround the first vibration plate and electromagnetic sounding body.

3. An electroacoustic converter comprising:

an enclosure;

a piezoelectric sounding body that includes a first vibration plate supported directly or indirectly on the enclosure, and a piezoelectric element placed at least on one side of the first vibration plate, and divides an interior of the enclosure into a first space and a second space;

an electromagnetic sounding body having a second vibration plate and positioned in the first space;

a passage provided at the piezoelectric sounding body or around the piezoelectric sounding body, to connect the first space and second space; and wiring members led out toward the electromagnetic sounding body, from the piezoelectric element, through the first space or second space, wherein the enclosure has a support that directly or indirectly supports a periphery of the vibration plate, and side walls that surround the first vibration plate and electromagnetic sounding body, wherein the electromagnetic sounding body has a periphery surface that engages with the side walls, and a first guide groove that is provided on the periphery surface and stores the wiring members.

4. An electroacoustic converter according to claim 3, further provided with a ring-shaped member between the periphery of the first vibration plate and the electromagnetic sounding body, wherein the ring-shaped member has a support surface that supports the electromagnetic sounding body, and a second guide groove that is provided on the support surface, connects to the first guide groove, and stores the wiring members.

5. An electroacoustic converter according to claim 3, further provided with a ring-shaped member between the periphery of the first vibration plate and the electromagnetic sounding body, wherein the ring-shaped member has a contact surface that contacts the support, and a second guide groove that is provided on the contact surface, connects to the first guide groove, and stores the wiring members.

6. An electroacoustic converter comprising:

an enclosure;

a piezoelectric sounding body that includes a first vibration plate supported directly or indirectly on the enclosure, and a piezoelectric element placed at least on one side of the first vibration plate, and divides an interior of the enclosure into a first space and a second space;

an electromagnetic sounding body having a second vibration plate and positioned in the first space;

a passage provided at the piezoelectric sounding body or around the piezoelectric sounding body, to connect the first space and second space; and wiring members led out toward the electromagnetic sounding body, from the piezoelectric element, through the first space or second space, said electroacoustic converter further provided with a cover that has a pressure part to press the electromagnetic sounding body toward the support and which closes the enclosure in an air-tight manner.

7. An electroacoustic converter comprising:

an enclosure;

a piezoelectric sounding body that includes a first vibration plate supported directly or indirectly on the enclosure, and a piezoelectric element placed at least on one side of the first vibration plate, and divides an interior of the enclosure into a first space and a second space;

an electromagnetic sounding body having a second vibration plate and positioned in the first space;

a passage provided at the piezoelectric sounding body or around the piezoelectric sounding body, to connect the first space and second space; and wiring members led out toward the electromagnetic sounding body, from the piezoelectric element, through the first space or second space, wherein the enclosure has a support that directly or indirectly supports a periphery of the vibration plate, and side walls that surround the first vibration plate and electromagnetic sounding body, said electroacoustic converter further provided with a cover that has a pressure part to press the electromagnetic sounding body toward the support and which closes the enclosure in an air-tight manner.

8. An electroacoustic converter according to claim 3, further provided with a cover that has a pressure part to press the electromagnetic sounding body toward the support and which closes the enclosure in an air-tight manner.

9. An electroacoustic converter according to claim 4, further provided with a cover that has a pressure part to press the electromagnetic sounding body toward the support and which closes the enclosure in an air-tight manner.

10. An electroacoustic converter according to claim 5, further provided with a cover that has a pressure part to press the electromagnetic sounding body toward the support and which closes the enclosure in an air-tight manner.

11. An electroacoustic converter according to claim 3, wherein the passage is provided in a thickness direction of the first vibration plate.

12. An electroacoustic converter according to claim 4, wherein the passage is provided in a thickness direction of the first vibration plate.

13. An electroacoustic converter according to claim 5, wherein the passage is provided in a thickness direction of the first vibration plate.

14. An electroacoustic converter according to claim 6, wherein the passage is provided in a thickness direction of the first vibration plate.

15. An electroacoustic converter according to claim 1, wherein an opening shape of the through hole is circular or oval.

16. An electroacoustic converter comprising:

an enclosure;

a piezoelectric sounding body that includes a first vibration plate supported directly or indirectly on the enclosure, and a piezoelectric element placed at least on one side of the first vibration plate, and divides an interior of the enclosure into a first space and a second space;

an electromagnetic sounding body having a second vibration plate and positioned in the first space;

a passage provided at the piezoelectric sounding body or around the piezoelectric sounding body, to connect the first space and second space; and wiring members led out toward the electromagnetic sounding body, from the piezoelectric element, through the first space or second space, wherein the passage is provided in a thickness direction of the first vibration plate, wherein a planar shape of the piezoelectric element is polygonal, and the passage is provided in an area between sides of the piezoelectric element and the periphery of the first vibration plate.

17. An electroacoustic converter comprising:

an enclosure;

a piezoelectric sounding body that includes a first vibration plate supported directly or indirectly on the enclosure, and a piezoelectric element placed at least on one side of the first vibration plate, and divides an interior of the enclosure into a first space and a second space;

an electromagnetic sounding body having a second vibration plate and positioned in the first space;

a passage provided at the piezoelectric sounding body or around the piezoelectric sounding body, to connect the first space and second space; and wiring members led out toward the electromagnetic sounding body, from the piezoelectric element, through the first space or second space, wherein the passage is provided in a thickness direction of the first vibration plate, wherein the passage is constituted by multiple cutouts formed along the periphery of the first vibration plate.

* * * * *